US006349885B1

(12) United States Patent
Parrish

(10) Patent No.: US 6,349,885 B1
(45) Date of Patent: Feb. 26, 2002

(54) FUEL INJECTOR FOR INTERNAL COMBUSTION ENGINES AND METHOD FOR MAKING SAME

(75) Inventor: Scott E. Parrish, Kenosha, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/540,698

(22) Filed: Mar. 31, 2000

Related U.S. Application Data

(63) Continuation-in-part of application No. 09/268,077, filed on Mar. 12, 1999.

(51) Int. Cl.[7] ..... F02D 1/06

(52) U.S. Cl. ..... 239/5; 239/453; 239/533.12; 29/890.142; 29/890.143

(58) Field of Search ..... 239/533.1–533.12, 239/453, 584, 583, 585.1–585.5, 88, 90, 5; 29/890.142, 890.143, 890.128

(56) References Cited

U.S. PATENT DOCUMENTS 2,035,265 A * 3/1936 Edwards ..... 239/453
2,154,875 A * 4/1939 Streby ..... 239/453
2,602,005 A * 7/1952 Weldy ..... 239/453
2,753,217 A * 7/1956 Pecora, Jr. et al. ..... 239/453

* cited by examiner

*Primary Examiner*—David A. Scherbel
*Assistant Examiner*—Dinh Q. Nguyen
(74) *Attorney, Agent, or Firm*—Fletcher, Yoder & Van Someren

(57) ABSTRACT

A fuel injector nozzle includes a nozzle body and a poppet disposed in the body for reciprocating movement. The body has an internal bore surrounding the poppet. The internal bore tapers in a constant angle of taper from a front seating region to a fuel reservoir region. The poppet has a corresponding surface which diverges slightly from the bore. The surfaces of the bore and poppet form flow control surfaces which terminate in a sharp-edged orifice at the front face of the nozzle. When the poppet is displaced to an open or flow position, fuel is accelerated to the orifice and atomized into a combustion chamber. The poppet surface being formed so as to properly direct fuel after the poppet surface is machined.

29 Claims, 4 Drawing Sheets

FUEL INJECTOR FOR INTERNAL COMBUSTION ENGINES AND METHOD FOR MAKING SAME

This application is CIP of Ser. No. 09/268,077 filed Mar. 12, 1999.

BACKGROUND OF THE INVENTION

1. Field of the Invention

The present invention relates generally to the field of injectors for internal combustion engines. More particularly, the invention relates to a novel geometry for a nozzle and poppet arrangement in an injector, particularly well suited for single fluid, pressure surge, direct in-cylinder fuel injection.

2. Description of the Related Art

In the field of internal combustion engines, various structures have been proposed over the years and are presently in use for providing the desired mix of fuel and gas, typically air, in combustion cylinders. In a particularly useful family of structures, an injector is fed with fuel and expresses fuel directly into a combustion chamber in a measured and properly timed sequence. The fuel is atomized upon injection into the chamber and is rapidly ignited by a spark plug to provide the rapid expansion needed to drive the engine.

It has been found that the performance of internal combustion engines may be substantially affected by the quality and characteristics of the atomization or spray provided by such injectors. In conventional injector structures, a central poppet or pintel is opened and closed within an injector nozzle body with each engine cycle, to introduce the desired quantity of fuel or fuel and gas mixture. When the poppet is displaced with respect to the body, a passageway is opened in an annular region between the poppet and a bore within the injector nozzle. Fuel flows through the passageway and enters into the combustion chamber where it is ignited. Prior to ignition, the poppet is withdrawn to its seating position within the bore to isolate the fuel feed from the combustion taking place in the chamber.

A wide variety of poppet-type fuel injectors have been developed to provide the desired sealing and flow of fuel into internal combustion engines. In general, the poppet may seat within the injector nozzle body at a position removed from the front or external surface of the body. The surfaces between the outer portion of the poppet and the injector nozzle body may take on various geometries, depending upon the desired fuel spray distribution, combustion properties, the strategy for cleansing the poppet and housing, and so forth. Alternatively, the poppet may be provided with a seating surface which contacts the injector body bore at some intermediate position between the tip of the poppet and more internal surfaces. Finally, injectors have been developed in which a poppet seats at a tip or toe located at or closely adjacent to the end of the poppet, where the poppet exits from the injector body during opening.

The various injector configurations heretofore proposed have advantages and drawbacks depending upon their particular application. For example, applications in which fuel is injected in a vapor or air carrier may be considerably different from those in which liquid fuel is conducted through the injector to the combustion chamber. In the former case, atomization of the fuel is performed prior to channeling of the fuel through the injectors. In the latter case, however, atomization occurs at the point of injection in the combustion chamber. The particular geometry of the injector nozzle body and poppet may be of considerable importance in obtaining good atomization in fuel injectors, particularly in systems in which the atomization is performed at the point of injection. However, heretofore known structures have not provided the most optimal atomization. Indeed, existing structures tend to cause inconsistent atomization, or insufficient breakdown of the fuel into a fine mist or spray as a result of the injector structure.

There is a need, therefore, for an improved fuel injector which overcomes these drawbacks of prior art devices. There is a particular need for an injector capable of reliably producing a fine spray or mist directly in a combustion chamber. Moreover, there is presently a need for such an injector structure which is robust to manufacturing variations and can be economically manufactured and installed in existing engine designs.

SUMMARY OF THE INVENTION

The invention provides a novel injector structure designed to respond to these needs. The injector is particularly well suited for applications in which liquid fuel is delivered to the injector tip where it is atomized directly into an engine combustion chamber. The injector may be driven in a variety of manners, such as by pulses in single fluid, pressure surge, direct in-cylinder fuel injection systems. The injector structure includes a nozzle body having a fuel flow bore, and a poppet or a pintel positioned within the bore. The region of the bore near the injector forms a flow controlling surface, with a corresponding surface being provided on the poppet. An annular region formed between the bore and the poppet serves to store a reservoir of fuel. Generally conforming surfaces of the poppet and bore, immediately adjacent to the injector tip, seat within one another to prohibit the ingress of combustion products and the outflow of fuel into the combustion chamber, when the injector is closed. The poppet is displaceable to an injection or flow position wherein the flow controlling surfaces adjacent to the injector tip direct or channel fuel to the injector tip, accelerating the fuel as it approaches the combustion chamber. The surfaces of the body and the poppet at the injector tip form a sharp-edged orifice promoting excellent atomization of the liquid fuel as it enters the combustion chamber. The body and poppet are machined to produce a planar surface. The surface of the poppet being formed so that after the poppet is machined, sufficient surface remains to properly direct fuel into the combustion chamber.

The invention also provides a novel method for forming an injector assembly. The method permits the formation of the various subcomponents of the assembly prior to assembly of the poppet and related structures in the injector nozzle body. Thereafter, the injector assembly is processed to form a flush tip surface with the front surface of the poppet extending in a common plane with the valve body, generally perpendicular to the central axis of the poppet. The surface of the poppet being formed so that after the poppet is machined, sufficient surface remains to properly direct fuel into the combustion chamber. The poppet and valve body seat is defined beginning at the plane and extending rearwardly into the valve body. The method permits the economical manufacture of injectors capable of providing superior atomization of liquid fuels by virtue of the creation of a sharp-edged orifice at the injector tip.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
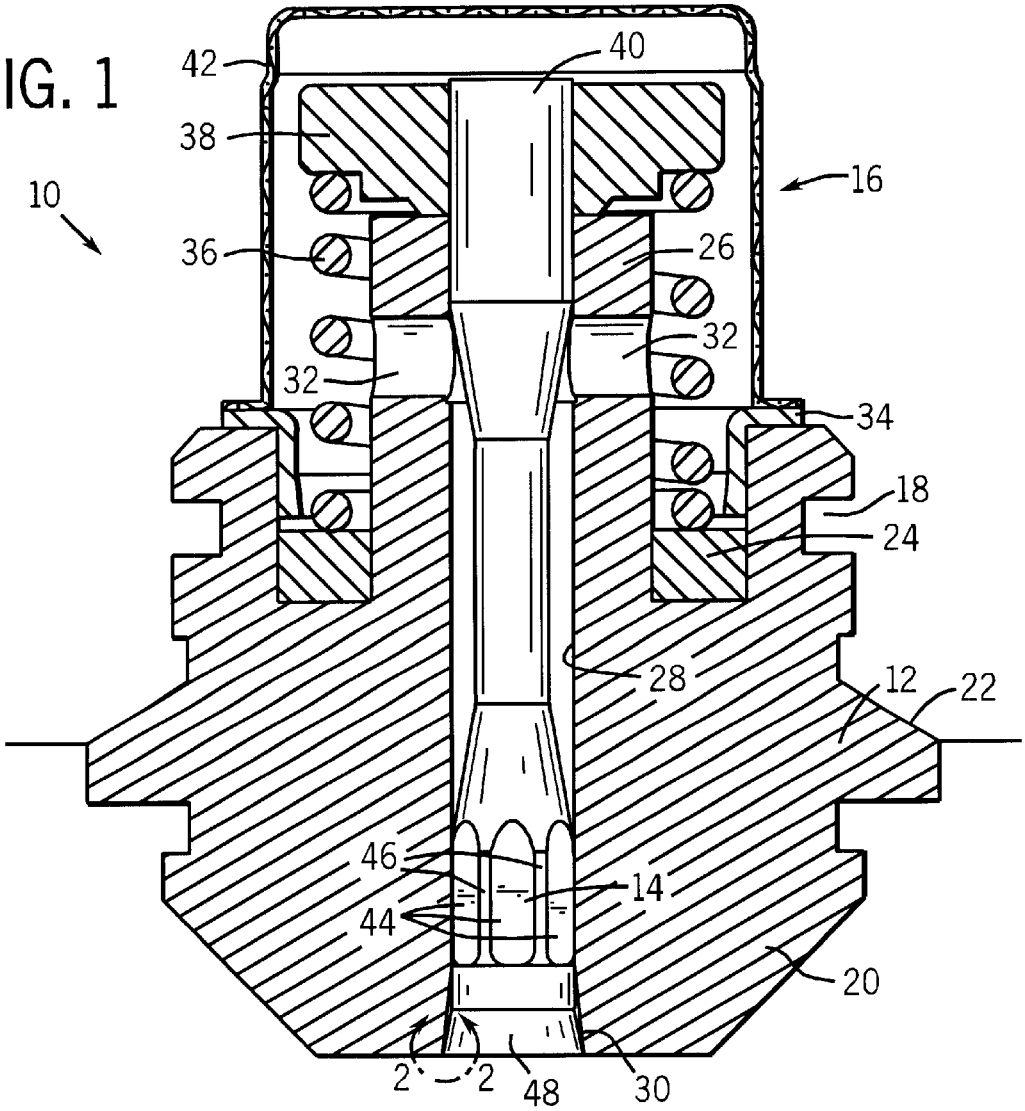
FIG. 1 is a sectional view of an injector nozzle assembly for channeling liquid fuel to a combustion chamber and for atomizing the fuel finely into the combustion chamber during operation.

Turning now to the drawings and referring first to FIG. 1, an injector nozzle assembly 10 is illustrated in partial longitudinal section. Injector nozzle 10 is particularly adapted to receiving and delivering a flow of liquid fuel, such as gasoline, to a combustion chamber in which the injector nozzle is installed. The injector nozzle assembly includes a body 12 in which a poppet or pintel 14 is positioned for reciprocal movement. A return and securement assembly 16 is assembled between the poppet 14 and the body 12 to maintain the poppet in the body, to seal the poppet in the body as described below, and to force return of the poppet to a seated position during operation.

The body 12 of injector nozzle 10 is designed to be installed directly in an aperture in an injector structure (not shown), which is, in turn, secured in a combustion chamber, such as in the head of a cylinder of an internal combustion engine. Accordingly, the injector nozzle body 12 includes features for facilitating installation of the injector in the receiving aperture and for sealing the injector nozzle in the injector structure and the combustion chamber. A retaining ring 18 is formed in the outer peripheral surface of the nozzle body to receive a retaining ring (not shown) which bears against surfaces of the injector structure to maintain the nozzle installed therein. A radially extending projection protrudes from the injector nozzle body and forms a seat 22 surrounding a tip 20 secured in the receiving aperture of the injector structure. Seat 22 thus seals against an interior surface of an injector. The front surface of tip 20 also seats against a surface of cylinder head in which the injector nozzle is installed. As will be appreciated by those skilled in the art, when installed in the combustion chamber, the injector nozzle seats prohibit the exchange of fuel and gases between the combustion chamber and the regions surrounding the injector nozzle. In general, the injector serves to atomize fuel channeled to the combustion chamber during operation, the atomized fuel being mixed with a gas such as air in the combustion chamber and ignited by an ignition device, such as a spark plug (not shown).

A generally annular inner groove 24 is formed in body 12 rearward of seat 22. This groove, with adjacent structures, serves to receive supporting components for the return and securement assembly 16. A central valve extension 26 is formed coaxially with groove 24 for receiving fuel and for directing the fuel toward the injector nozzle tip. In the illustrated embodiment, valve extension 26 extends around a central bore 28 through which fuel is delivered to the injector nozzle tip. Fuel-directing channels 32 are provided for receiving liquid fuel and for directing a flow of fuel to bore 28. Fuel thus flows from channels 32 through bore 28 to the tip of the injector nozzle, exiting in an atomizing region designated generally by reference numeral 30 in FIG. 1.

It should be noted that the structure illustrated and described herein may be adapted for use in fuel injection systems of various types. In particular, the structure is well suited to single-fluid, pressure surge direct in-cylinder fuel injection. In a particularly preferred arrangement, the injector may be installed in engines in which lost motion hammer effect-type fuel injection is practiced. As will be appreciated by those skilled in the art, such injection is effectuated through the creation of pressure pulses in the fuel which force the injector to open in a sequence of operations timed with the ignition of the fuel in the combustion chamber and the reciprocation of piston and power transmission assemblies of the engine.

The return and securement assembly 16 is positioned between the nozzle body and the poppet. In the illustrated embodiment, the securement assembly includes a flanged ring 34 which fits in and around groove 24 of the injector body. A compression spring 36 fits within the flanged ring 34 and extends around valve extension 26. A retainer 38 is secured to a rear or upper end 40 of the poppet. Spring 36 is compressed between retainer 38 and generally annular inner groove 24 to urge the poppet into an upward, retracted or seated (i.e., first) position as illustrated in FIG. 1. A screen 42 is conveniently secured about the return and securement assembly 16 to filter fuel introduced into the injector nozzle via channels 32.

The injector nozzle 10 includes surfaces specifically adapted to control and direct flow of fuel from bore 28 into the combustion chamber. These flow surfaces also serve to accumulate or store fuel in bore 28 and in staging areas as the fuel approaches region 30 of the injector nozzle. Moreover, the flow surfaces serve to accelerate the liquid fuel as it approaches the injector tip, and to cause a rapid reduction in pressure as the fuel is introduced into the combustion chamber, thereby providing enhanced atomization of the liquid fuel in the combustion chamber.

In the illustrated embodiment, the flow directing surfaces include surfaces 44 generally upstream of atomizing region 30. Surfaces 44 permit fuel to flow generally equally radially around the poppet, between surfaces 44 and bore 28. Alignment surfaces 46 are provided between flow surfaces 44 to maintain alignment of the poppet within the valve body. The poppet terminates in a flow preparation and control section, designated generally by reference numeral 48 in FIG. 1, which serves, in cooperation with specially adapted interior surfaces of the bore, to store, accelerate, and direct fuel flowing through the injector into the combustion chamber.

Figure 2:
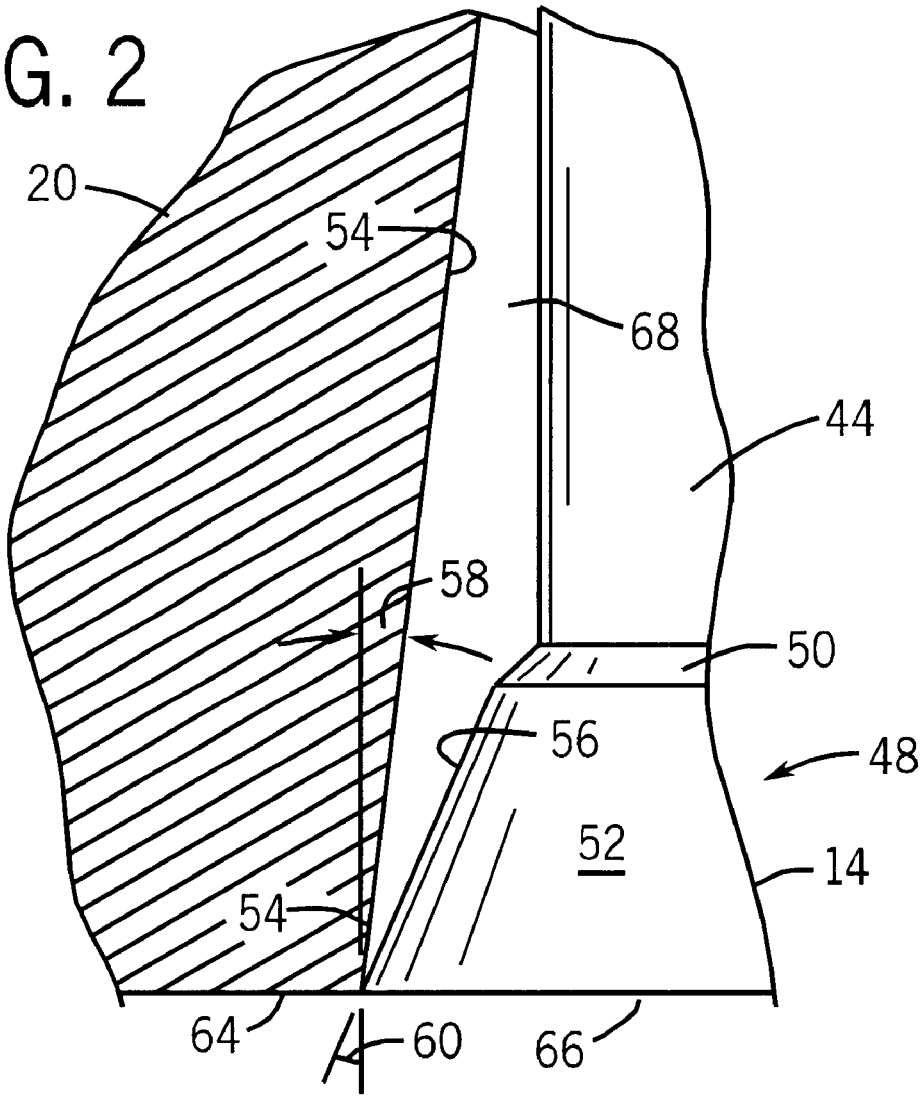
FIG. 2 is a detailed view of a region of the injector nozzle of FIG. 1 in the vicinity of the injector tip with the injector poppet in a closed position with respect to the injector body.

FIG. 2 illustrates a particular configuration for flow preparation and control section 48 within region 30, in accordance with a presently preferred embodiment. In general, the flow preparation and control section 48 is defined by slightly tapered or inclined surfaces extending between flow surface 44 and a front seating surface of the poppet and bore. These surfaces may assume various geometric configurations, as discussed in greater detail below. In the illustrated embodiment, however, a first surface, which may be designated as a fuel feed section 50, is defined as a continuation of flow surface 44. A front seat section 52 extends from fuel feed section 50 and is contiguous with the fuel feed section for the smooth flow of fuel through the front portion of the injector nozzle. Surrounding fuel feed section 50 and seat section 52, bore 28 opens into a slightly inclined outer flow directing surface 54. Surface 54 is preferably an elongated, tapering annular surface having a continuous angle of taper with respect to a central axis of the injector nozzle body and poppet. An inner flow directing surface 56 is formed on the poppet in mutually facing position with respect to flow directing surface 54 of the bore.

The continuous and gradual convergence of flow directing surfaces 54 and 56 permit the local storage of fuel adjacent to flow preparation and control section 48, as well as the acceleration of fuel for the purposes of atomization upon introduction into the combustion chamber. As mentioned above, outer flow directing surface 54 preferably has an elongated, slight taper which is uninterrupted between the front surface of the injector and the inner portion of the bore. Inner flow directing surface 56, on the other hand, may assume various shapes, including multi-faceted arrangements, sloping or arcuate arrangements, and so forth. In the illustrated embodiment, seat section 52 generally conforms to the taper of flow directing surface 54 of the bore, but has a slightly greater divergence angle with respect to the bore when viewed from the nozzle front face. In particular, in a presently preferred configuration, outer flow directing surface 54 has an angle of taper (i.e., a first angle of taper) 58, with respect to a longitudinal or central axis of the poppet, of approximately 12°. Inner flow directing surface 56 has a slightly greater angle of taper (i.e., a second angle of taper) 60 of approximately 13° with respect to the central axis of the poppet. In practice, all or a portion of seat section 52 immediately adjacent to the front surface of the injector body and the front surface of the poppet may become conforming, particularly over time, to the taper angle of outer flow directing surface 54, owing to mechanical forces created upon impact of the poppet within the injector body. While the foregoing geometry is particularly preferred, it should be noted that alternative angles may be selected. Moreover, the angles at which the flow directing surfaces 54 and 56 diverge from one another beginning at seat section 52 are selected generally to enhance the flow of fuel through the injector toward front surfaces 64 and 66 of the valve body and poppet. Thus, the poppet comprises a portion of a circular cone extending at a second angle of taper 60 to the central axis from a first diameter of the poppet 100 to a sealing surface adjacent to an end surface at a second diameter of the poppet 102, the second angle of taper 60 being larger than the first angle of taper 58.

Figure 3:
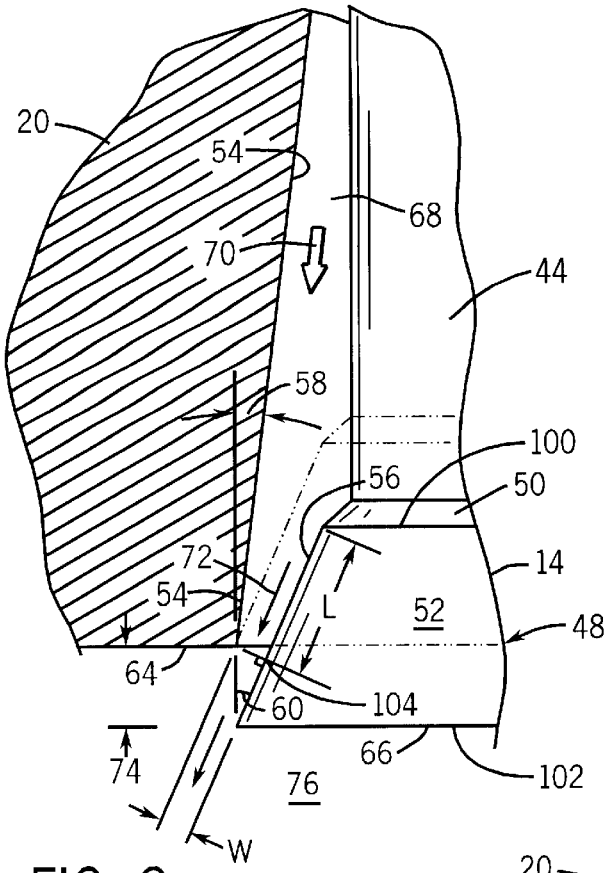
FIG. 3 is a detailed view of the components illustrated in FIG. 2 with the injector poppet extended into its open or flow position for atomizing liquid fuel.

FIG. 3 illustrates the foregoing surfaces and structure in an open flow or injection (i.e., second) position. As indicated above, the poppet may be displaced axially outwardly of the body, such as under the influence of pressure surges or pulses imparted on the fuel. When the poppet is thus extended from the nozzle body, fuel 70 within the reservoir section 68 flows toward flow directing surfaces 54 and 56. The convergence of surface 56 with surface 54 significantly accelerates the fuel flow under pressure. Moreover, the continuous taper of bore surface 54 provides smooth, even flow and acceleration of the pressurized fuel. As fuel approaches the front surfaces 64 and 66 of the injector, the accelerated fuel 72 is discharged through an annular passage formed between flow directing surfaces 54 and 56. Depending upon the distance of extension, as noted by reference numeral 74 in FIG. 3, of the poppet beyond the surface 64 of the valve body, a sharp-edged orifice is defined which abruptly decreases the pressure of the fuel stream, finely atomizing the fuel as it is introduced into the reduced-pressure volume within the combustion chamber, as designated generally at reference numeral 76. In a presently preferred configuration, the front surface 66 of the poppet in its fully opened position extends approximately 125 microns beyond the front surface 64 of the valve body.

FIG. 3 also illustrates the effect of angle of taper 58 of outer flow directing surface 54, angle of taper 60 of inner flow directing surface 56, and the length of inner flow directing surface 56 on the flow of fuel into the combustion chamber. When the poppet is in the open flow or injection position, fuel is directed through a flow constriction, referenced as "w", in the annular passage. The flow constriction is produced between inner flow directing surface 56 and outer flow directing surface 54 because of the difference in the angles of taper of flow directing surfaces 58 and 60. In the presently preferred embodiment, the length of inner flow directing surface 56 is made sufficiently long, relative to the width of the flow constriction, so that internal fuel flow is well defined. Inner flow directing surface 56 has less influence on the direction of internal fuel flow as the length of inner flow directing surface 56 decreases relative to the width of the flow constriction. In the presently preferred configuration, the poppet is manufactured so that, before machining, the distance along flow directing surface 56 from fuel feed section 50 to the flow constriction (i.e., between a first diameter 100 and a third diameter 104 shown in FIG. 3), referenced as "L", is at least ten times the width of the flow constriction. This insures that, even after machining, inner flow directing surface 56 has sufficient influence so that the internal fuel flow, upstream of the flow constriction, is well defined and the flow of fuel properly directed into the combustion chamber. The specific geometry of fuel feed section 50, seat section 52 and flow directing surfaces 54 and 56 can be varied greatly depending upon the desired flow characteristics of the fuel. Thus, a third diameter is defined, as illustrated at point 104 in FIG. 3, on the flow direction surface 56 that marks a shortest distance "w" between the inner flow directing surface 56 and the outer flow directing surface 54, the distance "L" along the surface of the inner flow directing surface 56 from the first diameter 100 to the third diameter 104 being longer than the shortest distance "W" between the inner flow directing surface 56 and the outer flow directing surface 54.

Figure 4:
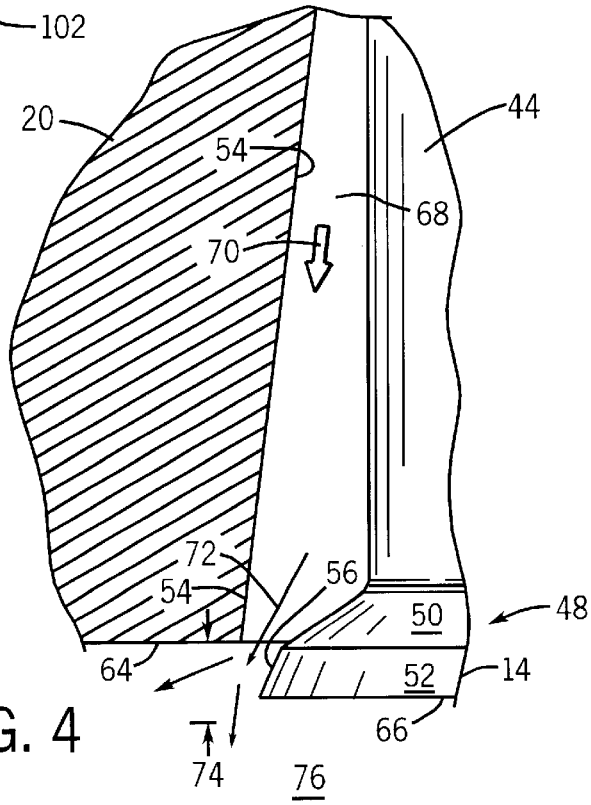
FIG. 4 is a detailed view of a region of an injector nozzle illustrating a flow directing surface of insufficient length.

FIG. 4 illustrates the effect of the length of inner flow directing surface 56 on the direction of the flow of fuel into the combustion chamber. In the illustrated embodiment, it is desired that fuel be influenced by flow directing surface 54 and 56 prior to exiting the injector. However, in the illustrated embodiment, inner flow directing surface 56 is not long enough to influence and properly direct all, or a significant portion, of the fuel into the combustion chamber.

The foregoing structure has been found to provide significantly enhanced atomization of liquid fuel introduced into combustion chambers by virtue of the flow-directing surfaces and the sharp-edged orifice defined by surfaces 54 and 56, and surfaces 64 and 66. To facilitate manufacture of the sharp-edged orifice, the foregoing structure is preferably processed as follows: The various subcomponents described above are first formed and are assembled as illustrated in FIG. 1. In this assembly process, the poppet is inserted into bore 28, and secured to retainer 38, with spring 36 being compressed between the retainer and generally annular inner groove 24. As originally manufactured, fuel feed section 50 and seat section 52 are preformed on the poppet. However, the front surfaces 64 of the valve body and surface 66 of the poppet do not necessarily fall within a common plane. That is, poppet surface 66 may extend beyond front surface 64 of the valve body as originally manufactured, or vice versa.

Figure 5:
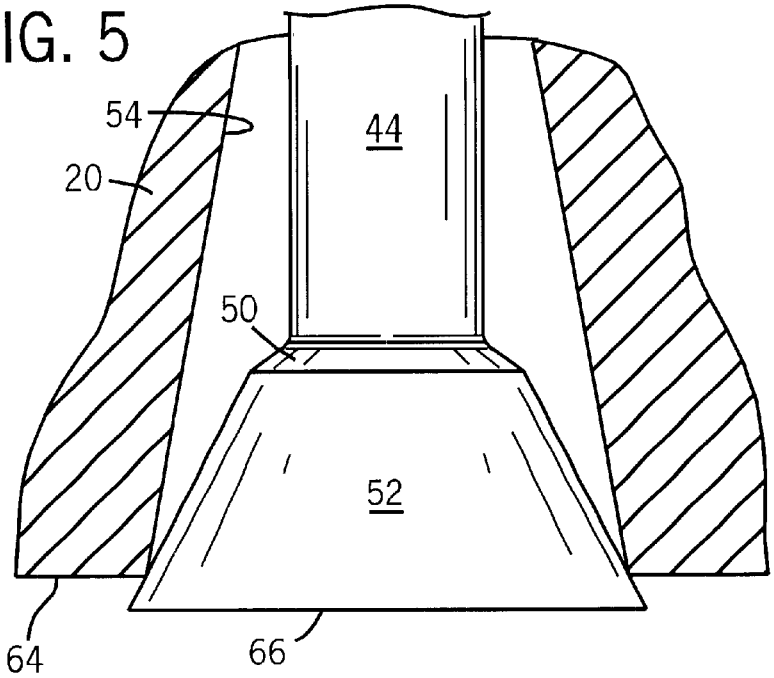
FIG. 5 is a detailed view of a region of an injector nozzle during assembly, prior to machining the injector poppet and the injector tip.

FIG. 5 illustrates the poppet and valve body during assembly, as originally manufactured. Surfaces 64 and 66 are subsequently machined together, such as in a grinding or lapping operation, to provide a flush, contiguous front edge or surface as best shown in FIG. 2, wherein the surfaces 64 and 66 lie in a common plane. Again, the creation of this sharp surface enhances atomization of the fuel by defining a sharp-edged orifice upon opening of the injector during operation. However, the machining operation on surface 66 shortens the length of inner flow directing surface 56. In accordance with the present technique, however, inner flow directing surface 56 has sufficient length, prior to machining, so that fuel is properly directed into the combustion chamber, after machining.

Figure 6:
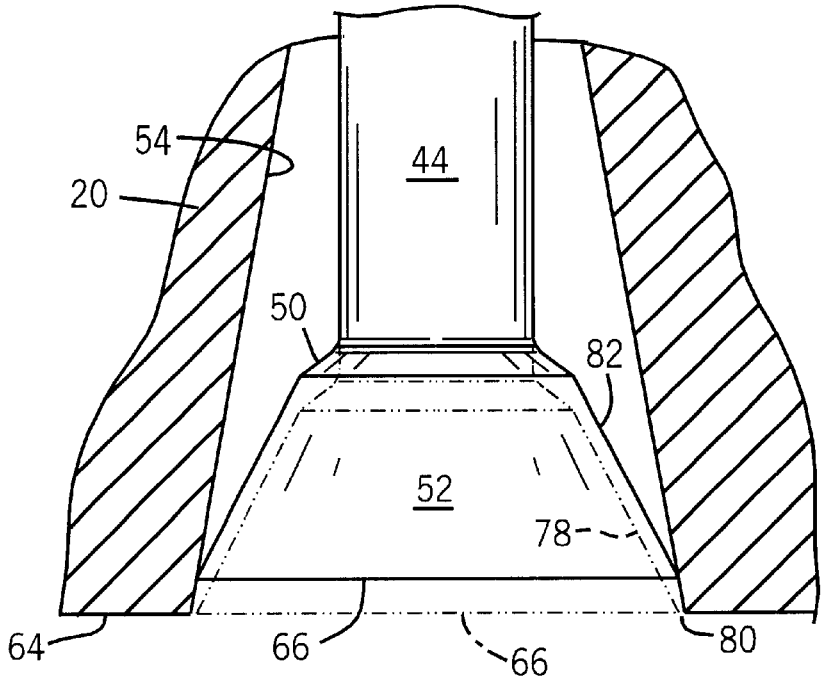
FIG. 6 is a detailed view of a region of an injector nozzle during assembly, during machining operations on the injector poppet and the injector tip.

As illustrated in FIG. 6, machining of both surfaces 64 and 66 may be needed to produce a planar surface that properly seals poppet 14 against valve body 12. A planar surface that seals may not be produced across surfaces 64 and 66 after machining of surface 66 alone because of the difference in the angles of taper of flow directing surfaces 54 and 56. The difference in the angles of taper of flow directing surfaces 54 and 56, and the length of flow directing surfaces 54 and 56, may cause the surface area of surface 66 to be smaller than the respective area of the bore of valve body 12 after initial machining. Thus, with the poppet at its initial position 78 after the initial machining, a gap 80 may be produced between surface 64 and 66. If that is the case, poppet 14 retracts into the valve body at position 82 to seal the seat section 52 against the valve body 12. Therefore, further machining will effectively alter surface 64, and possibly surface 66, to produce a coplanar face.

It will be understood that the foregoing description is of a preferred embodiment of this invention, and that the invention is not limited to the specific form shown. For example, the angles of taper of the flow directing surfaces may vary. The angles of taper of the fuel feed section 50 and the seal section may be made the same. Additionally, inner flow directing surface 56 may be longer, or shorter, than ten times the width of the flow constriction as necessary to produce the desired flow characteristics of the fuel into the combustion chamber. These and other modifications may be made in the design and arrangement of the elements without departing from the scope of the invention as expressed in the appended claims.

What is claimed is:

1. An injector nozzle assembly for directing a flow of fuel from a source to a combustion chamber of an internal combustion engine, the assembly comprising:

a nozzle having a planar tip surface and a bore defining an outer flow directing surface, the bore comprising a portion of a circular cone extending from an internal region to a seat portion adjacent to the planar tip surface at a first angle of taper in relation to a central axis; and a poppet defining an inner flow directing surface, centered within the bore along the central axis, and moveable between a sealed position and a flow position, the poppet comprising a portion of a circular cone extending at a second angle of taper to the central axis from a first diameter of the poppet to a sealing surface adjacent to an end surface at a second diameter of the poppet, the second angle of taper being larger than the first angle of taper, wherein when the poppet is in the sealed position the inner flow directing surface is sealed against the seat portion of the outer flow directing surface and the end surface is substantially coplanar with the planar tip surface, and when the poppet is in the flow position fuel is directed into the combustion chamber between the inner flow directing surface and the outer flow directing surface, there being a third diameter on the inner flow directing surface that marks a shortest distance between the inner flow directing surface and the outer flow directing surface, the distance along the surface of the inner flow directing surface from the first diameter to the third diameter being longer than the shortest distance between the inner flow directing surface and the outer flow directing surface.

2. The system as recited in claim 1, wherein the length of the inner flow directing surface from the first diameter to the third diameter on the inner flow directing surface that marks the shortest distance between the inner flow directing surface and the outer flow directing surface is at least 3 times longer than the shortest distance between the inner flow directing surface and the outer flow directing surface.

3. The system as recited in claim 1, wherein the length of the inner flow directing surface from the first diameter to the third diameter on the inner flow directing surface that marks the shortest distance between the inner flow directing surface and the outer flow directing surface is at least 5 times longer than the shortest distance between the inner flow directing surface and the outer flow directing surface.

4. The system as recited in claim 1, wherein the length of the inner flow directing surface from the first diameter to the third diameter on the inner flow directing surface that marks the shortest distance between the inner flow directing surface and the outer flow directing surface is at least 7 times longer than the shortest distance between the inner flow directing surface and the outer flow directing surface.

5. The injector assembly of claim 1, wherein the length of the inner flow directing surface from the first diameter to the third diameter on the inner flow directing surface that marks the shortest distance between the inner flow directing surface and the outer flow directing surface is at least 10 times longer than the shortest distance between the inner flow directing surface and the outer flow directing surface.

6. The injector assembly of claim 1, wherein the poppet comprises a circular cone extending at a third angle of taper to the central axis from a poppet shaft to the first diameter.

7. The injector assembly of method of claim 1, wherein fuel is disposed between the inner and outer flow directing surfaces when the poppet is in the sealed position.

8. The injector assembly of claim 1, wherein the portion of a circular cone extending from an internal region to a seat portion adjacent to the planar tip surface comprises a frustum of a right circular cone.

9. The injector assembly of claim 1, wherein the outer flow directing surface has an angle of inclination of approximately 12 degrees with respect to the central axis.

10. The injector assembly of claim 1, wherein the poppet extends approximately 125 microns from the nozzle when the poppet is in the flow position.

11. The injector assembly of claim 1, wherein the outer flow directing surface diverges from the inner flow directing surface from the seat portion towards the reservoir portion.

12. The injector assembly of claim 11, wherein the inner and outer flow directing surfaces diverge from one another at an angle of approximately 1 degree.

13. An injector nozzle assembly for directing a flow of fuel from a source to a combustion chamber of an internal combustion engine, the assembly comprising:

a nozzle having a planar tip surface and a bore defining an outer flow directing surface, the bore having a central axis and forming a concave circular cone extending at a first angle of taper to the central axis from an internal region to a seat portion adjacent to the planar tip surface; and a poppet defining an inner flow directing surface, centered within the bore along the central axis, and moveable between a sealed position and a flow position, the poppet forming a portion of a circular cone extending at a second angle of taper to the central axis from a first diameter of the poppet to a sealing surface adjacent to an end surface at a second diameter of the poppet, the second angle of taper being larger than the first angle of taper, wherein the inner flow directing surface is sealed against the seat portion of the outer flow directing surface and the end surface being substantially coplanar with the planar tip surface when the poppet is in the sealed position, and wherein fuel is injected into the combustion chamber, when the poppet is in the flow position, at an angle relative to the central axis, the angle being greater than or equal to the first angle of taper and less than or equal to the second angle of taper.

14. The system as recited in claim 13, wherein fuel is injected into the combustion chamber when the poppet is in the flow position at an angle in relation to the central axis, the angle being approximately equal to the second angle of taper.

15. The system as recited in claim 14, wherein when the poppet is in the flow position there is a point on the inner flow directing surface that marks the smallest distance between the inner flow directing surface and the outer flow directing surface, the distance along the surface of the inner flow directing surface from the first diameter to the point being longer than the shortest distance between the inner flow directing surface and the outer flow directing surface.

16. The fuel injection nozzle of claim 13, wherein the first angle of taper is approximately 10–15 degrees with respect to the central axis.

17. The fuel injection nozzle of claim 13, wherein the planar face and the poppet face define a sharp edged orifice when the poppet is in the flow position.

18. The fuel injection nozzle of claim 13, wherein the inner and outer flow directing surfaces are frustoconical surfaces.

19. The fuel injection nozzle of claim 13, wherein the difference between the second angle of taper and the first angle of taper is approximately 1 degree.

20. A method for making a nozzle for a fuel injector, the method comprising the steps of:

providing a nozzle body having a front tip and a bore extending from the front tip around a central axis;

providing a poppet having an outer surface configured to fit within the bore, wherein the poppet forms an inner flow directing surface and the bore forms an outer flow directing surface and wherein the poppet comprises a portion of a circular cone extending from a first diameter of the poppet to a sealing surface adjacent to an end surface at a second diameter of the poppet;

securing the poppet within the bore such that in a first position a seating surface of the poppet adjacent to a front face thereof contacts a seating region of the bore, and in a second position a third diameter is defined on the inner flow directing surface that marks a shortest distance between the inner flow directing surface and the outer flow directing surface;

machining the front tip of the nozzle body and the front face of the poppet following assembly such that the front tip and the front face extend in a common plane substantially perpendicular to the central axis; and providing the inner flow directing surface with sufficient length so that after machining the distance along the surface of the inner flow directing surface from the first diameter to the third diameter is longer than the shortest distance between the inner flow directing surface and the outer flow directing surface.

21. The system as recited in claim 20, wherein the length of the inner flow directing surface from the first diameter to the third diameter is at least 10 times longer after machining than the shortest distance between the inner flow directing surface and the outer flow directing surface.

22. The method of claim 20, wherein the step of machining is performed by grinding the nozzle body and poppet.

23. The method of claim 20, wherein the step of machining is performed by lapping the nozzle body and poppet.

24. The method of claim 20, wherein the nozzle body has a continuously tapering internal flow control surface extending from the front tip and the poppet has a corresponding flow control surface extending from the front face.

25. The method of claim 24, wherein the internal flow control surface of the nozzle body converges inwardly beginning at the front tip at an angle of approximately 12 degrees with respect to the central axis.

26. The method of claim 24, wherein the flow control surface of the poppet diverges from the internal flow control surface of the nozzle body by a varying angle to form a fuel reservoir.

27. The method of claim 20, wherein following the machining step, the front tip and the front face form a sharp-edged orifice when the poppet is displaced to a flow position with respect to the nozzle body.

28. A method for making a nozzle for a fuel injector, the method comprising the steps of:

providing a nozzle body having a front tip and a conical-shaped bore extending from an interior region to the front tip at a first angle of taper to a central axis;

providing a poppet having a conical outer surface configured to fit within the bore at a second angle of taper to the central axis, wherein the poppet forms an inner flow directing surface and the bore forms an outer flow directing surface;

securing the poppet within the bore such that in a first position a seating surface of the poppet adjacent to a front face thereof contacts a seating region of the bore and in a second position fuel is directed into the combustion chamber between the inner flow directing surface and the outer flow directing surface;

machining the front tip of the nozzle body and the front face of the poppet following assembly such that the front tip and the front face extend in a common plane substantially perpendicular to the central axis; and providing the inner flow directing surface with sufficient length so that after machining fuel is injected into the combustion chamber at an angle relative to the central axis, the angle being greater than or equal to the first angle of taper and less than or equal to the second angle of taper.

29. An injector nozzle assembly for directing a flow of fuel from a source to a combustion chamber of an internal combustion engine, the assembly comprising:

a nozzle having a planar tip surface and a bore defining an outer flow directing surface, the bore having a central axis and forming a concave circular cone extending at a first angle of taper to the central axis from an internal region to a seat portion adjacent to the planar tip surface; and a poppet defining an inner flow directing surface, centered within the bore along the central axis, and moveable between a sealed position and a flow position, the poppet forming a portion of a circular cone extending at a second angle of taper to the central axis from a first diameter of the poppet to a sealing surface adjacent to an end surface at a second diameter of the poppet, the second angle of taper being larger than the first angle of taper, wherein the inner flow directing surface is sealed against the seat portion of the outer flow directing surface and the end surface being substantially coplanar with the planar tip surface when the poppet is in the sealed position, wherein fuel is injected into the combustion chamber, when the poppet is in the flow position, at an angle relative to the central axis, the angle being greater than or equal to the first angle of taper and less than or equal to the second angle of taper, and wherein the nozzle body and the poppet are assembled and subsequently machined to form the planar face and the end surface.

* * * * *